US005107554A

United States Patent [19]

Garakani

[11] Patent Number: 5,107,554

[45] Date of Patent: Apr. 28, 1992

[54] PORTABLE LIFTING APPARATUS AND METHOD

[76] Inventor: Mojtaba Garakani, 8009 Willet Trail, Austin, Tex. 78745

[21] Appl. No.: 697,643

[22] Filed: May 8, 1991

[51] Int. Cl.[5] ..... A61G 7/00

[52] U.S. Cl. ..... 5/84.1; 5/89.1; 5/611; 5/620

[58] Field of Search ..... 5/63, 66, 76, 83, 84, 5/88, 90

[56] References Cited

U.S. PATENT DOCUMENTS

| | | | |
|---|---|---|---|
| 236,188 | 8/1903 | Wyssa | 5/83 |
| 769,579 | 9/1904 | Wright et al. | 5/84 |
| 926,033 | 6/1909 | Taylor et al. | 5/84 |
| 952,957 | 3/1910 | Sterling | 5/83 |
| 1,284,356 | 11/1918 | Johnson | 5/84 |
| 1,630,453 | 5/1927 | Savitz | 5/76 |
| 3,959,832 | 6/1976 | Parsons | 5/84 |
| 4,222,133 | 9/1980 | Csatary | 5/90 |
| 5,040,253 | 8/1991 | Cheng | 5/76 X |

FOREIGN PATENT DOCUMENTS

| | | | |
|---|---|---|---|
| 14138 | of 1929 | Australia | 5/76 |

*Primary Examiner*—Michael F. Trettel

*Attorney, Agent, or Firm*—J. Nevin Shaffer, Jr.; Russell D. Culbertson

[57] ABSTRACT

A portable lifting apparatus and method having a pair of oppositely positioned end pieces to which are attached lifting devices. A support is attached between the end pieces upon which an individual rests. The support contains at least one access opening so that access for a bed pan, for airing bed sores, for changing bandages and linen, is provided. Further, a leveling device is attached to the support for maintaining the support in a level position as the patient is lifted and lowered above the bed. The end pieces may be attached to any existing bed in a hospital or nursing home or elsewhere and the support is conformed to the size and dimension of the bed to which it is attached. The device is remotely operable and, if the patient is capable, may actually be operated by the patient so as to enable the patient to raise and lower himself above the bed for use of a bed pan, and so forth.

12 Claims, 3 Drawing Sheets

PORTABLE LIFTING APPARATUS AND METHOD

BACKGROUND OF THE INVENTION

This invention relates to a portable, lifting apparatus and method for raising a person above a bed.

Manual lifting and automatic repositioning mechanisms and methods have been known in the art for quite some time for moving a patient on a bed. For example, in hospitals, severely injured patients commonly require two to four or more nurses to intricately, gently, lift a patient on to a bed pan. Yet, in many cases, when the patient is critically injured, the patient will suffer injuries, internal bleeding, fractures to fragile bones, and a great deal of pain due to the movement of different sections of his body by the nurses. Getting the patient to that radical position without causing extreme discomfort and then moving the patient back to his or her original position after utilizing the bed pan, takes an extreme amount of time and effort for the injured patient to endure and for the hospital staff. A major concern about this manual movement known in the art, is that the time that elapses before the number of required hospital personnel can be assembled from their other pressing duties is often considerable. A second related concern is how long the patient will have to be in discomfort before the task can be done and how long it takes for the staff to come back and reposition the patient in the original position.

Other individuals, in particular the elderly, are also faced with a problem. That is, will they need to hire expensive outside help if they are bed-ridden or impose on their families to assist them? Individuals assisting the elderly who happen to be bed-ridden, must ask themselves can they lift that person by themselves, for bed pan use and bathing and changing linens, etc., and can they continue to do this for an extended length of time without harm to their own physical health?

Of the mechanical devices for moving patients in beds, the Applicant is aware of only those types of beds which raise or lower a persons head or back, or legs, while on the bed itself. None of these prior art mechanical beds, of which Applicant is aware, enable the user or the operator of the bed to raise the patient or bed-ridden person above the bed for use of a bed pan, airing of the patient's body to prevent bed sores, changing linen, or the like. Once again, even in light of the mechanical beds known in the art, it is still necessary, in the case of an injured or bed-ridden person, to assemble a staff of people to raise them physically above the bed so they can use the bed pan, change the linen, etc. Thus, there is a need in the art for providing a portable or fixed, lifting apparatus and method which automatically raises a person above a bed so as to provide access to a bed pan, dressing change, airing of some of the body to prevent bed sores, etc., that does not require a host of important, highly paid and trained individuals to do the lifting. It, therefore, is an object of this invention to provide an absolute lifting apparatus and method to be used in conjunction with existing beds, or integral to specially built beds, for automatically raising and lowering injured and/or bed-ridden individuals above a bed for these purposes.

SUMMARY OF THE INVENTION

Accordingly, the portable lifting apparatus and method of the present invention includes a pair of oppositely positioned end pieces to which are attached lifting devices. A support for an individual, patient/invalid, is attached to the lifting devices. The support is provided with access ports so that access to the person on the support is provided. Further, the device incorporates a leveling apparatus attached to the support that maintains the support in a level position throughout the lifting and lowering operation of the device. The lifting mechanism is comprised of a combination of motors, cables, pulleys, rails and rollers that enable the lifting of the individual upon the support means in a level manner above the bed. Once the individual is raised above the bed in the laying position, the individual then may be raised to a sitting position. The leveling mechanism prevents any sagging in the support while the individual is raised to the sitting position. The rails of the device on the head section are curved so that the sitting position is adjustable through an infinite range but, in the preferred embodiment, results in a person sitting up at an angle of more than 90°. Further, the device of the present invention includes a series of limit switches that limit extension and retraction of the lifting device within specified ranges. Further, a hand-held remote control is provided for the operation of the lifting device at a distance from the bed by either a trained operator or by the bed-ridden individual himself while lying in the bed.

BRIEF DESCRIPTION OF THE DRAWINGS

Other objects, features and advantages of the present invention will become more fully apparent from the following detailed description of the preferred embodiment, the appended claims, and the accompanying drawings in which:

DESCRIPTION OF THE PREFERRED EMBODIMENTS

Figure 1:
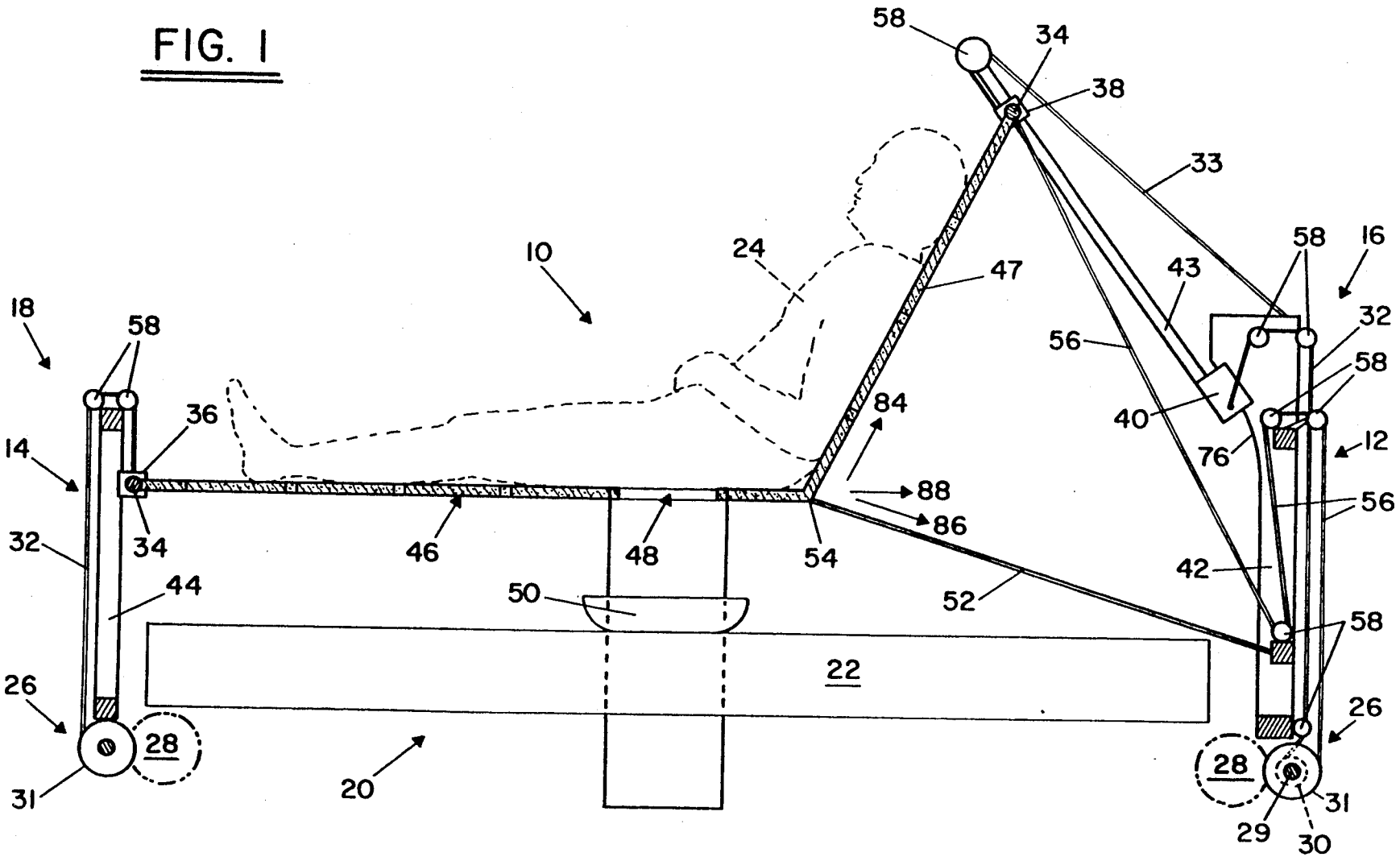
FIG. 1 is a side sectional view, taken along lines 1—1 of FIG. 2, of a preferred embodiment of the portable lifting device of the present invention showing a patient raised above a bed for use of a bed pan.
Figure 2:
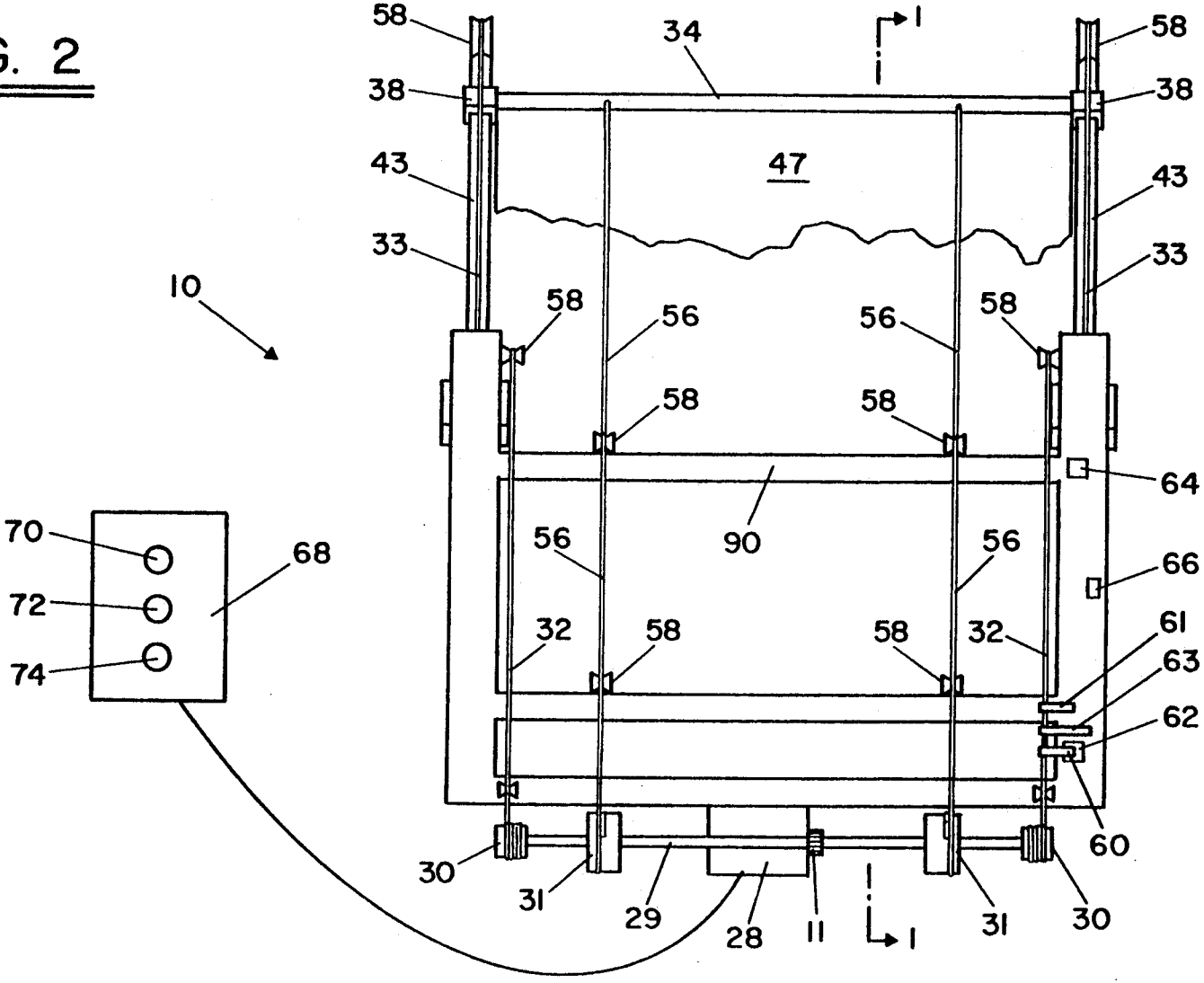
FIG. 2 is an end view of the head rest end of the device.
Figure 3:
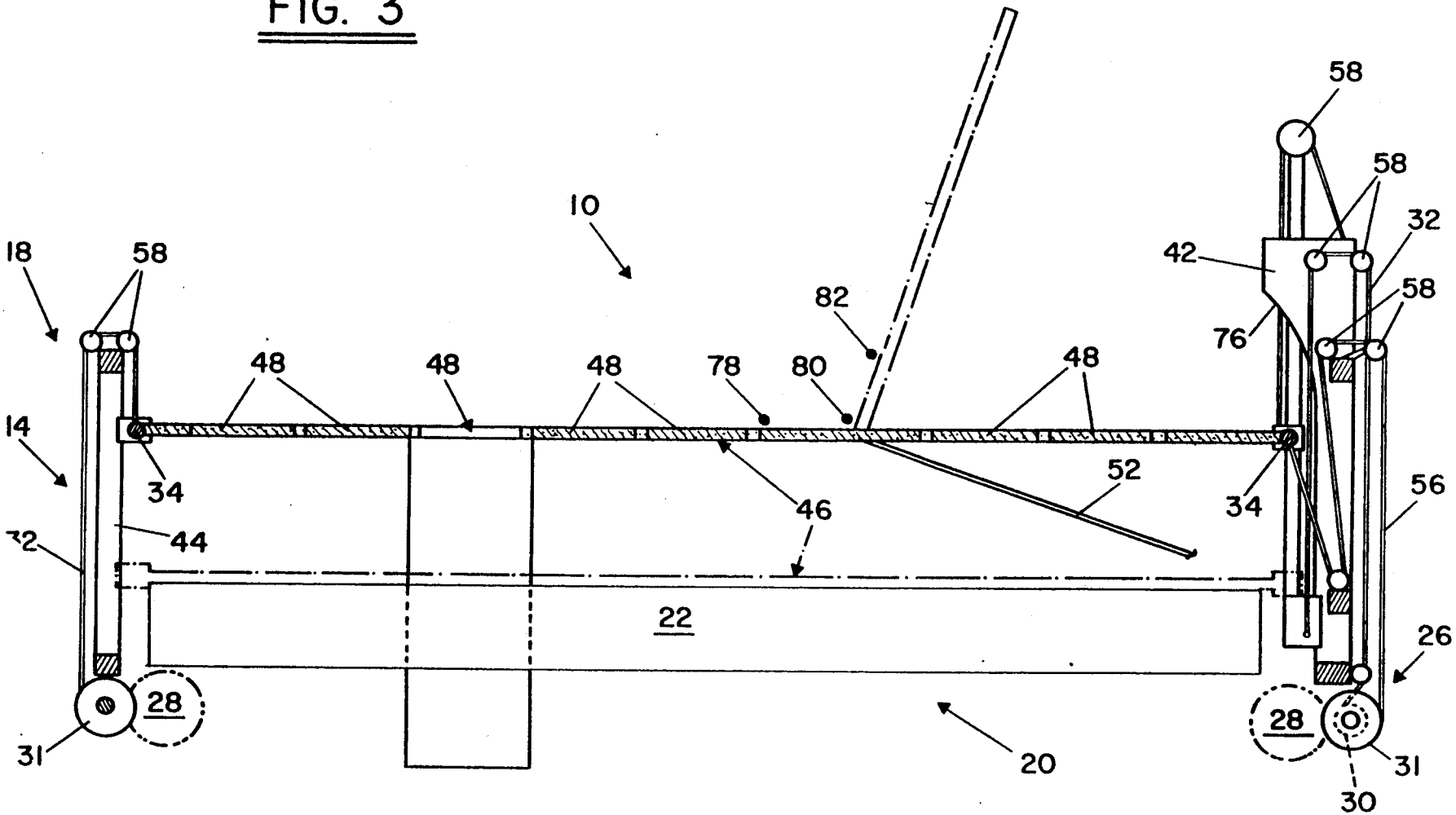
FIG. 3 is a side sectional view as in FIG. 1 showing the head rest in the raised position in dotted lines and in the lowered horizontal position raised above the bed and then, in dotted lines, showing the device lowered upon the mattress of an ordinary bed.

The preferred embodiment of the present invention is illustrated by way of example in FIGS. 1-3. With specific reference to FIG. 1, a portable lifting apparatus 10 is comprised of a pair of oppositely positioned end pieces 12 and 14. End piece 12 corresponds with the head rest end 16 and end piece 14 corresponds with foot rest end 18 of bed 20, not shown in detail but as is known commonly in the art. Mattress 22 of bed 20 is shown to illustrate the level at which patient 24 would rest and the level above which the patient will be raised as will be described further. Each end piece 12 and 14 has an attached lifting device 26. Lifting device 26 is comprised of motor 28 and two gears 11 and a shaft 29, to which are attached pulleys 30 and 31. A pair of lifting cables 32 are attached at one end to pulleys 30 and to the other end to master rollers 40. Lifting cable 33 is fixed at one end to end piece 12 and attached at the opposite end to slave roller 38.

Connecting bar 34, at the foot rest end 18 of bed 20, is connected to master roller 36 while connecting bar 34 at head rest end 16 of bed 20 is connected to slave roller 38. Master roller 40 at head rest end 16 is attached to master rail 42 while the foot rest master roller 36 is attached to master rail 44 at the foot rest end of the bed. Slave roller 38 is slidably engaged to slave rail 43 which is slidably engaged with master rail 42 at head rest end 16.

Strung between connecting bars 34 is support 46. Support 46 has upper end section 47 and at least one opening 48 that is removably attachable to support 46 by means of hook and loop attachments, zippers, snaps, buttons or any other known and appropriate connecting devices so that once the patient 24 has been raised above the bed, bed pan 50 can be inserted beneath and utilized.

Leveling section 52 is attached at the head rest end 16, to end piece 12 at one end. The other end of leveling section 52 is attached (at attachment point 54) across the width of support 46 at a distance approximately one-third of the distance from head rest end 16 and approximately two-thirds of the distance from foot rest end 18. FIG. 1 also shows retracting cable 56 and several cable guides 58 that insure the smooth play-out and reel-in of the various cables.

Referring now to FIG. 2, an end view of portable lifting apparatus 10 from the head rest end 16 is provided. As in FIG. 1, support 46 is in the raised sitting position, with upper end section 47 raised, and lifting cables 32 are fully wound on pulleys 30. Conversely, retraction cables 56 are fully extended and unwound from the respective pulleys 31 to which they are attached.

FIG. 2 illustrates other features of the invention. Cable 32 has 3 limit switch activators. Limit switch activator 60 is shown contacting upper limit switch 62 thereby insuring that the device stops in its upward movement at that point. Conversely, as the device is lowered to bed 20 and supported by mattress 22, lower limit switch 64 will be contacted by limit switch activator 61 to stop the device in its downward horizontal movement. As upper end section 47 is being lowered, limit switch activator 63, in its upward movement, contacts bumper switch 66 when section 47 levels off with support 46. Bumper switch 66 when contacted, energizes motor 28 at the foot rest end 18 and causes the foot rest end 18 to start moving downward together with the head rest end 16 resulting in lowering support 46, and upper section 47, until it rests on mattress 22. A similar combination of limit switch activator 60 and upper limit switch 62 (not shown) are provided at end piece 14 at foot rest end 18 of bed 20 to insure that the foot rest end 18 stops in its upward movement at the appropriate level equal to the level of support 46 and upper end section 47 at the head rest end 16 before head rest end 16, upper end section 47, is raised to the sitting position.

Also shown is hand-held remote control 68. Remote control 68 has a number of operating functions. The "Up Lay" control 70 raises support 46 vertically above bed 20 and mattress 22 while keeping patient 24 in a horizontal position. "Up Sit" button 72 raises upper section 47 and, hence, patient 24 to a sitting position. "Down" control 74 lowers patient 24 from the sitting position, if that is the position in which the patient has been placed, to the horizontal "Up Lay" position. If the patient is just in the "Up Lay" position, "Down" control 74 lowers the patient to resting position on top of mattress 22.

Referring now to FIG. 3, portable lifting apparatus 10 is shown in the "Up Lay" position wherein patient 24 has been raised vertically above bed 20 in a horizontal position. The fully down position is illustrated by means of dotted lines wherein support 46 rests directly on top of mattress 22. Dotted lines also form the head rest end of support 46 to show it in the raised position while solid lines show it in the horizontal "Up Lay" position.

Both FIG. 1 and FIG. 3 illustrate the curve 76 of master rail 42 upon which master roller 40 travels. The curve 76 occurs at the upper end of master rail 42 and directs slave rail and slave roller 43 and 38, respectively, in the curved position that results in the "Up Sit" position as shown. This curve 76 can assume a variety of dimensions. However, the preferred embodiment results in the utilization of a curve 76 that yields an "Up Sitting" position wherein the patient is sitting at an angle of greater than 90° as generally shown in FIGS. 1 and 3 and as illustrated by the angle formed by connecting points 78, 80, and 82.

FIG. 3 also illustrates a preferred embodiment of the invention in that a plurality of openings 48 are provided so that large portions of the patient's body may be aired to prevent bed sores, so that dressings may be attended to easily and so that linen may be changed. The plurality of openings 48 would be utilized in the manner of a series of openings alternated along the body so that a maximum of support and openings are provided. That is, it is not anticipated that all the openings 48 would be opened at once. Alternative to this method of airing a patient's body, the support 46 material could be a mesh with no layers or openings other than a permanent opening for bed pan use.

Referring now back to FIG. 1, the function of support 46 is further explained. It is critical for severely injured patients and for the elderly, that as little as possible disturbance to their resting position be made while moving them. Leveling section 52 is designed to keep support 46 level when support 46 is raised above the horizontal plane. With foot rest end 18 stationary in the "Up Lay" position, as upper end section 47 of support 46 is raised, a force vector in direction of arrow 84 is created. At the same time, non-stretchable leveling section 52 creates a force vector on support 46 in the direction of vector arrow 86. The resultant force vector, in the direction of arrow 88, is the same as if upper end section 47 had remained in its original horizontal level position. As a result, support 46 does not droop or sag as the patient is lifted to the sitting position.

Referring now to FIG. 2, the flexibility of portable lifting device 10 is further amplified. That is, end cap section 90 shown here on head rest end 16, with a corresponding end cap 90 on foot rest end 18 of end piece 14, provide the ability of the device to be easily removably attached to existing beds. In the simplest version, end cap 90 is a u-shaped section with the open end of the "u" facing downward. The open end of the "u" is placed over the upper rail of an existing bed so that the device is supported by the existing bed rails. End caps 90 are adjustable to conform to any width and dimension of existing beds that may present themselves.

In operation, portable lifting apparatus 10 is assembled by placing end piece 12 at the head rest end 16 of bed 20 and end piece 14 at the foot rest end 18. End caps 90 are utilized to fit over the existing head and foot rest rails (not shown) of bed 20. End caps 90 may be secured in place by any known means, such as clamps, bolts, screws, and the like, not shown. Once end pieces 12 and 14 are in place, master rails 42 and 44 are attached to end pieces 12 and 14, again by any means known in the art such as screws, bolts, and the like. Motors 28, gears 11, shafts 29, pulleys 30 and 31, and cables 32, 33 and 56 are attached as illustrated. Connecting bars 34 are attached to support 46 at both the head, upper section 47, and the foot rest ends. Leveling section 52 is already connected to support 46 and head rest end 16 of end piece 12. Energizing motors 28, by means of an electrical plug connection known in the art and not shown, places the device in readiness for operation.

The device is initially situated with support 46 in the fully down position resting on top of mattress 22 of bed 20. Support 46 can be made of any suitable fabric and/or material. Preferably it is a unitary, flexible material at least an inch in thickness and with a plurality of openings 48 along its length and breadth. Support 46 can be covered with any suitable hospital dressing or linen as appropriate.

Patient 24 is then placed on support 46 with it in the fully down horizontal position. It is anticipated that this portable lifting apparatus 10 will be utilized with severely injured or severely disabled people primarily in intensive care situations. The device, however, is not so limited and, in fact, could be utilized wherever necessary, particularly in homes for the elderly. In any event, the device is utilized, once a patient 24 has been placed upon it, by the energizing of motors 28 that activate the turning of shafts 29 and attached pulleys 30 and 31 so that the patient, while laying horizontally, is lifted vertically above bed 20 without need of manual intervention. At a predetermined distance above bed 20 and mattress 22, the device is stopped. In this position, bed pan 50 may be inserted for utilization, openings 48 may be opened for allowing direct air to the underneath of patient 24, ie. the side formally pressed against the mattress, dressings changed or the like. Alternatively, "Up Sit" control 72 may be energized to raise upper end section 47 of support 46 along curve 76 so that the resulting sitting position is at an angle, detailed by points 78, 80, and 82 that is greater than 90°. In this position the patient can utilize bed pan 50 more comfortably perhaps, airing to prevent bed sores may be accomplished in a more confortable manner and/or dressings changed as appropriate. Leveling section 52, as shown by vector arrows 84, 86, and resultant vector arrow 88, maintains that portion of patient 24 that is still horizontal in a horizontal position without sagging or drooping, as previously disclosed.

Once the required task has been accomplished, a single person, or the patient if he or she is not too disabled, can lower the device to the horizontal position and back on top of the bed again by means of remote control 68.

While the portable lifting apparatus and method of the present invention has been disclosed in connection with cables and pulleys, obviously chains and sprockets and/or pneumatic or hydraulic fluid and the like could be substituted. However moved, the present invention provides a portable lifting apparatus and method which can be easily manipulated by a single individual, and possibly even the patient, to raise and lower the patient above an existing bed. Further, apparatus has a simple and reliable limiting system which stops the device in its maximum extended and retracted positions.

The above described preferred embodiments are intended to illustrate the principles of the invention, but not to limit the scope of the invention. Various other embodiments and modifications to these preferred embodiments may be made by those skilled in the art without departing from the scope of the following claims.

I claim:

1. A removably attachable lifting mechanism for beds comprising:

(a) a pair of oppositely positioned removably attachable end piece means conformed to attach to head and foot rests of an existing bed;

(b) a pair of oppositely positioned lifting means correspondingly attached to said end piece means;

(c) a unitary, flexible support means attached between said lifting means;

(d) at least one access means in said support means for access to a person on said support means;

(e) leveling means attached to said support means and said end piece means so that said support means is maintained in a level position upon lifting, and lowering, said person from said bed;

(f) master ails at both the head and foot ends of said bed;

(g) slave rails in communication with said master rail at said head end of said bed; and (h) connecting bar means, to which both ends of said support means are attached.

2. The mechanism of claim 1 wherein said lifting means further comprises:

(a) master rollers slidably engaged with said master rails;

(b) slave rollers slidably engaged with said slave rails;

(c) said connecting bar means attached to said master roller at said foot end and with said slave rollers at said head end;

(d) cables attached at one end to said connecting bars and at another end to pulleys; and (e) motor means attached to said end pieces with shafts upon which are mounted said pulleys so that when said motor means are operated in one direction said shafts turn said pulleys and said cables are wound up and said connecting bars, and hence said support means, are raised as said rollers roll up said rails.

3. The mechanism of claim 2 wherein said support means and said access means further comprise:

(a) a unitary, flexible, cushion-like mattress conformed to the dimensions of the bed upon which it is used; and (b) a plurality of openings in said support means covered by strips of said unitary, flexible, cushion-like mattress detachably secured to said support means so that access is provided for waste evacuation, airing for prevention of bed sores, dressing changes, linen changing, and the like.

4. The mechanism of claim 3 wherein said support means and said access means is comprised of a mesh material with a permanent opening for use with a bed pan.

5. The mechanism of claim 3 wherein said leveling means further comprises:

(a) a section of non-elastic material with a first and second end attached at said first end across the width of said support means at a point approximately one-third of the distance from said head rest and two-thirds of the distance from said foot rest; and (b) said second end attached to said end piece at said head rest end so that, as said support means is raised and lowered, constant tension is maintained by said leveling means at said support means attachment point thereby preventing said support means from sagging when said person is raised from laying to sitting and lowered from sitting to laying to resting on said bed.

6. The mechanism of claim 5 further comprising:

(a) master rails at said head rest end that are curved so that said slave rails and rollers and corresponding connecting bar trace a curve that results in a person sitting up at an angle of more than 90°;

(b) a series of limit switches that limit extension and retraction of said connecting bars along said rails; and (c) a remote control for operation of said lifting means at a distance from said bed.

7. A method for lifting persons from a bed comprising the steps of:

(a) constructing a pair of oppositely positioned end piece means;

(b) attaching lifting means to said end piece means;

(c) connecting support means to said lifting means;

(d) providing access means to said support means for access to a person on said support means;

(e) securing leveling means to said support means for maintaining said support means in a level position as said support means is lifted and lowered;

(f) placing a person on said support means;

(g) activating said lifting means so as to raise said person above said bed;

(h) attaching master rails at both the head and foot ends of said bed;

(i) constructing slave rails in communication with said master rail at said head end of said bed; and (j) providing connecting bar means to which both ends of said support means are attached.

8. The method of claim 7 wherein the step of attaching lifting means further comprises the steps of:

(a) slidably engaging master rollers with said master rails;

(b) slidably engaging slave rollers with said slave rails;

(c) attaching said connecting bar means to said master rollers at said foot end and to said slave rollers at said head end;

(d) attaching cables at one end to said connecting bar means and at another end to pulleys; and (e) attaching motor means to said end pieces with shafts upon which are mounted said pulleys so that, when said motor means are operated in one direction said shafts turn said pulleys and said cables are wound up, said connecting bars, and hence said support means, are raised as said rollers roll up said rails.

9. The method of claim 8 wherein the step of connecting said support means and providing said access means further comprises the steps of:

(a) constructing a unitary, flexible, cushion-like mattress as said support means conformed to the dimensions of the bed upon which it is used; and (b) providing access means in the nature of a plurality of openings in said support means covered by strips of said unitary, flexible, cushion-like mattress detachably secured to said support means so that access is provided for waste evacuation, airing for the prevention of bed sores, dressing changes, linen changing, and the like.

10. The method of claim 9 wherein the step of connecting said support means and providing said access means further comprises the step of constructing said support means of a mesh material with a permanent opening for use with a bed pan.

11. The method of claim 9 wherein the step of securing said leveling means further comprises the steps of:

(a) forming said leveling means from a section of non-elastic material with a first and second end attached at said first end across the width of said support means at a point approximately one-third of the distance from said head rest and two-thirds of the distance from said foot rest; and (b) attaching said second end to said end piece at said head rest end so that as said support means is raised and lowered constant tension is maintained by said leveling means at said support means attachment point thereby preventing said support means from sagging when said person is raised from laying to sitting and lowered from sitting to laying to resting on said bed.

12. The method of claim 11 further comprising the steps of:

(a) curving said master rails at said head rest end so that said slave rails and rollers and corresponding connecting bar means trace a curve that results in a person sitting up at an angle of more than 90°;

(b) providing a series of limit switches that limit extension and retraction of said connecting bar means along said rails; and (c) providing a remote control for operation of said lifting means.

* * * * *

UNITED STATES PATENT AND TRADEMARK OFFICE

CERTIFICATE OF CORRECTION

PATENT NO. : 5,107,554

DATED : April 28, 1992

INVENTOR(S) : Mojtaba Garakani

It is certified that error appears in the above-identified patent and that said Letters Patent is hereby corrected as shown below:

In Claim 1, Column 6, Line 19, change "ails" to --rails--.

Signed and Sealed this

Twenty-second Day of June, 1993

*Attest:*

Michael K. Kirk

MICHAEL K. KIRK

*Attesting Officer*

*Acting Commissioner of Patents and Trademarks*